US010119370B2

(12) United States Patent
Ocalan

(10) Patent No.: US 10,119,370 B2
(45) Date of Patent: Nov. 6, 2018

(54) KINETIC ENERGY STORAGE FOR WELLBORE COMPLETIONS

(71) Applicant: SCHLUMBERGER TECHNOLOGY CORPORATION, Sugar Land, TX (US)

(72) Inventor: Murat Ocalan, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/726,741

(22) Filed: Jun. 1, 2015

(65) Prior Publication Data

US 2016/0348477 A1 Dec. 1, 2016

(51) Int. Cl.
*E21B 34/06* (2006.01)
*E21B 41/00* (2006.01)

(52) U.S. Cl.
CPC ..... *E21B 41/0085* (2013.01); *E21B 34/066* (2013.01)

(58) Field of Classification Search
CPC ..... E21B 41/0085; E21B 34/066
See application file for complete search history.

(56) References Cited

U.S. PATENT DOCUMENTS 2,266,355 A * 12/1941 Chun ..... E21B 4/02 175/4.56
2,661,898 A 12/1953 Bubb
2,698,133 A 12/1954 Bubb
4,147,223 A * 4/1979 Patton ..... E21B 47/18 175/40
RE30,055 E * 7/1979 Claycomb ..... E21B 41/0085 367/84
4,297,087 A 10/1981 Akkerman
4,676,310 A * 6/1987 Scherbatskoy ..... E21B 23/10 166/113
4,721,172 A 1/1988 Brett et al.
5,336,061 A 8/1994 Armstrong
(Continued)

FOREIGN PATENT DOCUMENTS

WO 2008076809 A1 6/2008

OTHER PUBLICATIONS

Zhang, et al., "A novel flywheel energy storage system with partially-self-bearing flywheel-rotor", Jun. 2007, IEEE Transactions on Energy Conversion, vol. 22, No. 2, pp. 477-487.
(Continued)

*Primary Examiner* — Matthew R Buck

(57) ABSTRACT

A downhole kinetic energy storage system for wellbore completions is configured for installation downhole for extended periods of time, such as 10 year or more. The kinetic energy storage system receives power from a low power source, which can be due to a "power bottleneck" to the downhole location such as inductive coupling, optical fiber, downhole energy harvesting, and/or subsea wellhead configurations. The system stores the available low-power as rotational energy in a flywheel and then when demanded converts the rotational energy into electrical energy at a temporary power level exceeding the low power source. The temporary high power energy is used for wellbore completion applications such as actuating a flow control or other downhole valve.

18 Claims, 4 Drawing Sheets

(56) References Cited

U.S. PATENT DOCUMENTS

| | | | | |
|---|---|---|---|---|
| 5,839,508 | A * | 11/1998 | Tubel | G01V 1/42 166/65.1 |
| 7,633,248 | B1 * | 12/2009 | Williams | B66B 1/302 318/150 |
| 7,923,946 | B2 * | 4/2011 | Williams | B66B 1/302 318/150 |
| 8,033,328 | B2 * | 10/2011 | Hall | E21B 41/0085 166/65.1 |
| 9,667,117 | B2 * | 5/2017 | Ben David | H02K 7/025 |
| 2005/0012340 | A1 * | 1/2005 | Cousins | H02P 6/15 290/52 |
| 2008/0047753 | A1 | 2/2008 | Hall et al. | |
| 2008/0142215 | A1 * | 6/2008 | Pabon | E21B 47/00 166/254.2 |
| 2016/0084043 | A1 * | 3/2016 | Cobb | E21B 41/0085 166/244.1 |
| 2016/0258254 | A1 * | 9/2016 | Guo | E21B 41/0085 |

OTHER PUBLICATIONS

Lafoz, et al., "A 200 kVA prototype of kinetic energy storage system based on switched reluctance machine technology", Sep. 11-14, 2005, European Conference on Power Electronics and Applications, 8 pages.

Bolund, et al., "Flywheel energy and power storage systems", Feb. 2007, Renewable and Sustainable Energy Reviews, vol. 11, Issue 2, pp. 235-258.

Bitterly, et al., "Flywheel technology: past, present, and 21st century projections", Aug. 1998, IEEE AES Systems Magazine, vol. 13, Issue 8, 4 pages.

* cited by examiner

KINETIC ENERGY STORAGE FOR WELLBORE COMPLETIONS

FIELD

The subject disclosure generally relates to wellbore completions. More particularly, the disclosure relates to downhole kinetic energy storage systems for use with wellbore completions.

BACKGROUND

Modern wellbore completions make use of various power consuming devices that are located downhole. Examples include various types of electrically operated valves as well as other flow control devices such as electrically operated flow control sleeves. There are a number of 'power bottlenecks' in the wellbore completions systems, causing a limitation to downhole actuation of electrically operated downhole flow control devices. Examples of such power bottlenecks include subsea trees, inductive couplers, optical connections, and fluid flow energy harvesting systems. A completion system that has strong actuators may be limited by the amount of continuous power available at the downhole location due to these power bottlenecks.

Current technologies of storing downhole energy have operational limitations in permanent applications (~10 years) and elevated temperatures (>125° C.). This poses a challenge to the designers of completions systems that rely on power intensive actuation applications such as intelligent completions valves. Normally these systems require occasional actuation and hence minimal 'average' power over their lifetime; however, due to the limitation in downhole energy storage their power sources are designed for peak demand.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a downhole kinetic energy storage system is described that includes: a low power downhole source of energy; a rotating mechanical device (e.g. a flywheel) interconnected and configured to receive and store as rotational energy mechanical energy originating from the lower power downhole source of energy; and an electric machine interconnected and configured to convert mechanical energy from the rotating machine into high power electrical energy for use by a wellbore completion device (e.g. flow control valve, formation isolation valve, or safety valve). Actuation of the wellbore completion device temporarily uses energy at a rate exceeding that produced by the low power downhole source.

According to some embodiments, the electric machine is further interconnected and configured to convert electrical energy from the low power downhole source into mechanical energy for storage by the rotating mechanical device. According to some embodiments, the system is configured for permanent or semi-permanent deployment in a wellbore for more than 5 years. According to some embodiments, the system is configured for deployment in a wellbore for more than 10 years and/or in a wellbore having temperatures greater than 100 degrees Celsius. According to some embodiments the wellbore completion device is a flow control valve that forms part of an intelligent completion According to some embodiments, the low power downhole source of energy is energy transmitted through a subsea wellhead, inductive couplers, or optical connections. According to some other embodiments, the low power downhole source of energy is harvested from fluid flowing downhole, or from vibration, thermal and/or rotational energy.

According to some embodiments, the flywheel is formed at least in part of a fiber reinforced composite material. According to some embodiments, the flywheel is supported by magnetic bearings. The electric machine, for example can be a DC brush, DC brushless, switched reluctance, inductance, or AC electric machine. According to some embodiments, the high power electrical energy from the electrical machine is used to boost power past an inductive coupler such that it can be used by the wellbore completion device.

According to some embodiments, a method is described for storing kinetic energy for use downhole. The method includes: receiving a low power energy from a low power energy source; converting the received low power energy into rotational energy using an electric machine; and storing the rotational energy in a flywheel system. When needed, the rotational energy stored in the flywheel system is converted into high power electric energy; and a wellbore completion device is actuated using the high power electric energy. Actuating completion device used the high power electric energy at a rate exceeding that produced by the low power energy source.

Further features and advantages of the subject disclosure will become more readily apparent from the following detailed description when taken in conjunction with the accompanying drawings.

BRIEF DESCRIPTION OF THE DRAWINGS

It should be appreciated that these drawings depict only illustrative embodiments, and are therefore not to be considered limiting of the scope of this patent specification or the appended claims. The subject matter hereof will be described and explained with additional specificity and detail through the use of the accompanying drawings in which:

DETAILED DESCRIPTION

The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements.

Current technologies of storing downhole energy have operational limitations in permanent applications (~10 years) and elevated temperatures (>125° C.). This poses a challenge to the designers of completions systems requiring power intensive actuation applications such as intelligent completions valves. Normally these systems require occasional actuation and hence minimal 'average' power over their lifetime; however, due to the limitation in downhole energy storage their power sources are designed for peak demand.

There are a number of 'power bottlenecks' in the completions systems, causing a limitation to actuation of downhole devices. Examples of such power bottlenecks include: subsea trees, inductive couplers, optical connections, and flow energy harvesting systems. With a robust downhole energy storage system, a completion system with strong actuators can be energized using continuous power at a fraction of the peak demand.

Figure 1:
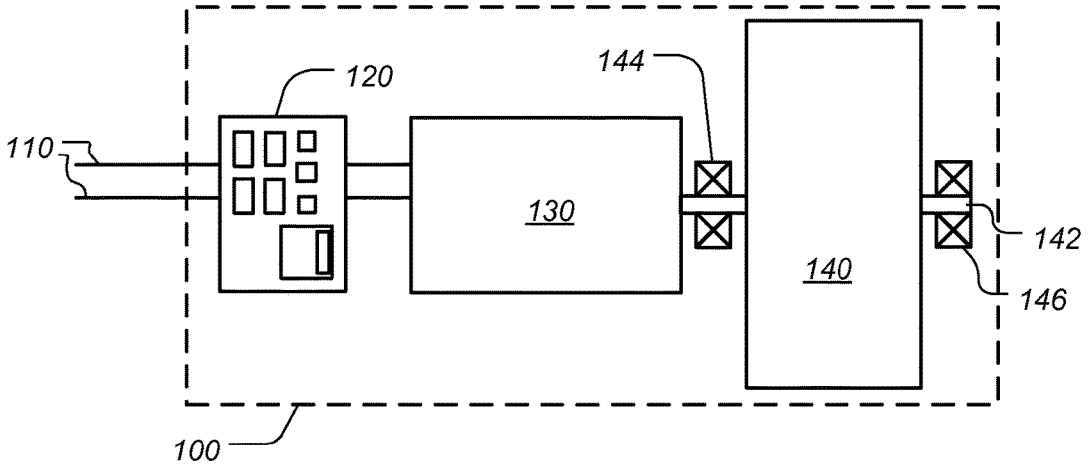
FIG. 1 is a schematic diagram illustrating certain aspects of a downhole kinetic energy storage system for wellbore completions, according to some embodiments.

FIG. 1 is a schematic diagram illustrating certain aspects of a downhole kinetic energy storage system for wellbore completions, according to some embodiments. Kinetic energy storage system (KESS) 100 includes an electric motor/generator 130 and a rotor 140 in the form of a separate flywheel. The system will normally include control electronics 120 to control motor/generator 130. According to some embodiments, the motor/generator 130 is DC brush, DC brushless, switched reluctance, or inductance and AC electric machines. The flywheel 140 is can be manufactured from various materials. However, according to some embodiments a high energy density system can be designed using fiber reinforced composite materials.

Flywheel 140 is shown supported by a shaft 142 and bearings 144 and 146. According to some embodiments the flywheel 140 uses "magnetic bearings" to support the load of the rotor by causing it to magnetically levitate. Further detail of magnetic bearings and magnetic levitation technology for use in downhole flywheel technology can be found in co-owned U.S. Pat. No. 8,033,328 (hereinafter referred to as the "'328 Patent"), which is incorporated herein by reference.

According to some embodiments the kinetic energy storage system 100 is used in conjunction with a fluid-flow energy-harvesting device to convert the low power output of the harvester into a high-power intermittent power supply and operate completions equipment such as a flow control valve. According to some embodiments, this is accomplished by supplying the system with kinetic energy using the energy harvester. In some cases, rotational energy from the energy harvester can be used to directly (e.g. through a transmission) drive flywheel 140. According to some other embodiments, the electrical energy output of the harvester is used by the control electronics 120 via electrical leads 110 to increase the speed of the flywheel 140 and thus storing kinetic energy. When sufficient energy is stored, the electric machine 130 is operated as a generator and the energy is supplied to the flow control valve.

The availability of downhole power may be limited as a consequence of a bottleneck in the completions power transmission systems. Some examples of power bottlenecks are subsea trees, inductive couplings and optical cables. In these cases the KESS can be used to generate a high-power intermittent power for subterranean components using the available low power source. Each of these example cases is described in greater detail below with respect to FIGS. 2, 3 and 4.

Figure 2:
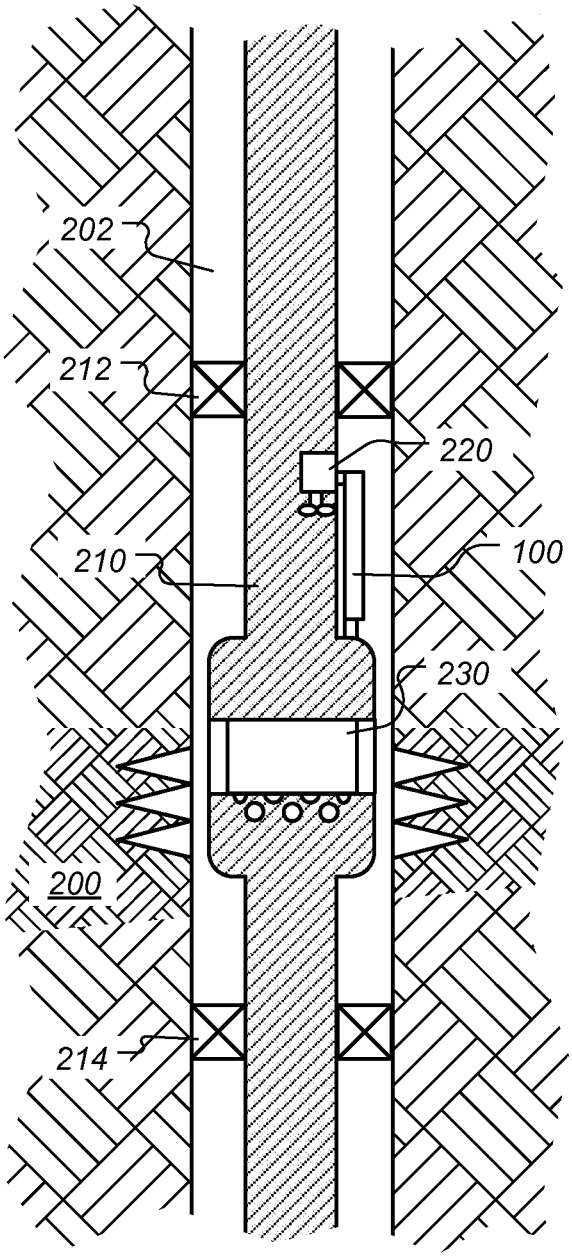
FIG. 2 is a schematic diagram illustrating certain aspects of a downhole kinetic energy storage system for wellbore completions that obtains low-power from a fluid flow energy harvester, according to some embodiments.

FIG. 2 is a schematic diagram illustrating certain aspects of a downhole kinetic energy storage system for wellbore completions that obtains low-power from a fluid flow energy harvester, according to some embodiments. Wellbore 202 penetrates the earth to production formation rock 200. Production tubing (or casing) 210 is positioned within wellbore 202 and includes an electrically powered flow control valve 230 to control fluid flow from formation 200 into production tubing 210. Packers 212 and 214 are used for isolation. For electrical power, a fluid-flow harvesting device 220 is positioned within the tubing 210. Fluid flowing upwards through tubing 210 through harvester 220 causes a turbine system to rotate, and a generator within harvester 220 is used to produce electrical power therefrom. Unfortunately, the turbine within harvester 220 generates power at rate that is too low for reliable operation of flow control valve 230. That is, during an actuation "event", flow control valve 230 uses energy at a rate that exceeds the average rate that energy can be produced by harvester 220. According to some embodiments, KESS 100 is used to store energy generated by harvester 220 so that the instantaneous energy demand by flow control valve 230 can be met.

According to some embodiments, instead of using a separate electrical generator within harvester 220, the mechanical energy from the turbine within harvester 220 is used to directly accelerate flywheel 140 within KESS 100. In such embodiments, the turbine's shaft can be connected to transmission (e.g. a continuously variable transmission) to accelerate flywheel 140. A continuously variable transmission, for example, can be used to gradually bring flywheel 140 up to speed by adjusting the "gear ratio" between the turbine of harvester 220 and the flywheel 140 of KESS 100. For further details of aspects of using a transmission to accelerate a flywheel in a downhole setting, refer to the '328 Patent. According to some embodiments, instead of harvesting energy from fluid flow, harvester 220 is configured to harvest energy downhole from vibrations, thermal sources and/or other forms of energy.

Figure 3:
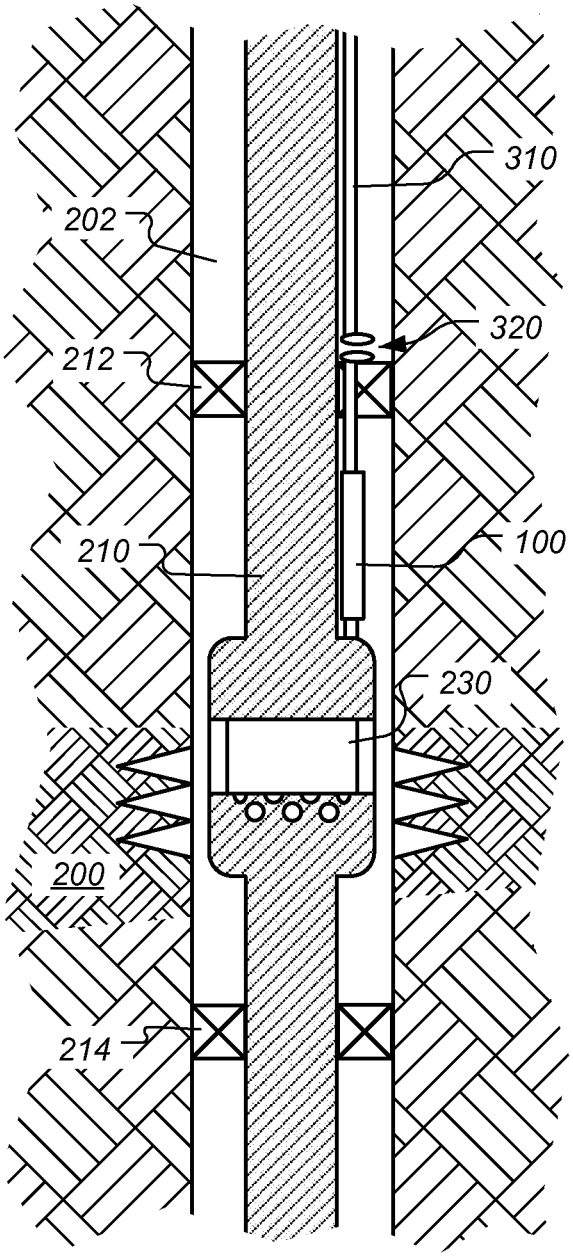
FIG. 3 s a schematic diagram illustrating certain aspects of a downhole kinetic energy storage system for wellbore completions that obtains low-power through an inductive coupling, according to some embodiments.

FIG. 3 s a schematic diagram illustrating certain aspects of a downhole kinetic energy storage system for wellbore completions that obtains low-power through an inductive coupling, according to some embodiments. As in the case of FIG. 2, wellbore 202 penetrates the earth to production formation rock 200. Production tubing (or casing) 210 is positioned within wellbore 202 and includes an electrically powered flow control valve 230 to control fluid flow from formation 200 into production tubing 210. Packers 212 and 214 are used for isolation. In this case, electrical power from the surface is transmitted through downhole electrical cable 310. An inductive coupling 320 acts as a power bottleneck such that the power passing through inductive coupling 320 is too low to meet the instantaneous power demand for actuation of flow control valve 230. According to some embodiments, KESS 100 is used to store energy transmitted through inductive coupling 320 so that the instantaneous energy demand by flow control valve 230 can be met. In particular, the power transmitted through inductive coupling 320 is used to accelerate flywheel 140 within KESS 100 (shown in FIG. 1). When demanded for actuation of the flow control valve 230, the KESS generates electrical energy from the flywheel and provides it to the actuator system for valve 230.

Figure 4:
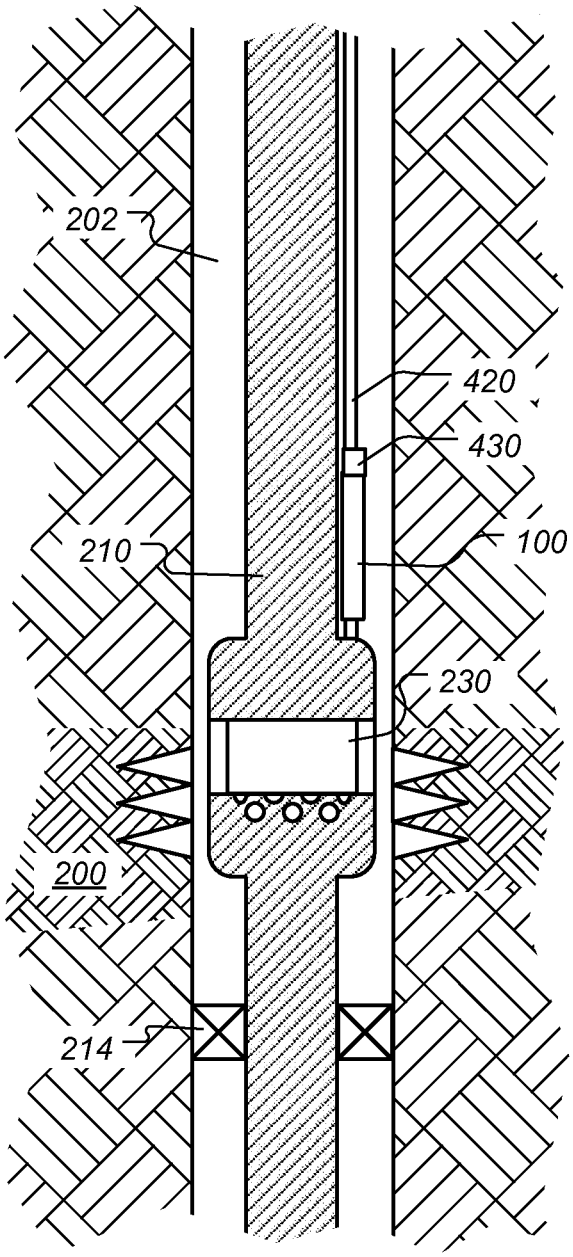
FIG. 4 is a schematic diagram illustrating certain aspects of a downhole kinetic energy storage system for wellbore completions that obtains low-power through an optical fiber connection, according to some embodiments.

FIG. 4 s a schematic diagram illustrating certain aspects of a downhole kinetic energy storage system for wellbore completions that obtains low-power through an optical fiber connection, according to some embodiments. As in the case of FIGS. 2 and 3, wellbore 202 penetrates the earth to production formation rock 200. Production tubing (or casing) 210 is positioned within wellbore 202 and includes an electrically powered flow control valve 230 to control fluid flow from formation 200 into production tubing 210. Packer 214 is used for isolation. In this case, a downhole optical cable 420 is provided. An optical-electrical transducer 430 converts optical energy from cable 420 into electrical energy for use downhole. However, the optical fiber power transmission system acts as power bottleneck such that the electrical energy available from transducer 430 is too low to meet the instantaneous power demand for actuation of flow control valve 230. According to some embodiments, KESS 100 is used to store energy from transducer 430 so that the instantaneous energy demand by flow control valve 230 can be met. In particular, the power from transducer 430 is used to accelerate flywheel 140 within KESS 100 (shown in FIG. 1). When demanded for actuation of the flow control valve 230, the KESS generates electrical energy from the flywheel and provides it to the actuator system for valve 230.

According to some embodiments, instead of flow control valve 230 in FIGS. 2, 3 and 4, another type of valve is actuated, such as a formation isolation valve or a safety valve. According to some embodiments, the valve 230 in FIGS. 2, 3 and 4 form part of an intelligent completion.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A downhole kinetic energy storage system comprising:

a low power downhole source of energy;

a rotating mechanical rotor interconnected and configured to receive and store mechanical energy originating from said low power downhole source of energy, the energy being stored as rotational kinetic energy in the downhole kinetic energy storage system;

an electric machine operable as a motor interconnected and configured to convert electrical energy from said low power downhole source into mechanical energy for storage by said rotating mechanical rotor and a generator interconnected and configured to convert mechanical energy from said rotating mechanical rotor into high power electrical energy for use by a wellbore completion device, wherein actuation of the wellbore completion device temporarily uses energy at a rate exceeding that produced by said low power downhole source.

2. The system according to claim 1 wherein said rotating mechanical rotor is a flywheel.

3. The system according to claim 1 wherein said rotating mechanical rotor, said electric machine and the wellbore completion device are configured for permanent or semi-permanent deployment in a wellbore for more than 5 years.

4. The system according to claim 3 wherein said rotating mechanical rotor, said electric machine and the wellbore completion device are configured for deployment in a wellbore for more than 10 years.

5. The system according to claim 1 wherein said rotating mechanical rotor, said electric machine and the wellbore completion device are configured for long-term deployment in a wellbore having temperatures greater than 100 degrees Celsius.

6. The system according to claim 1 wherein the wellbore completion device is of a type selected from a group consisting of: flow control valve, flow control sleeve, formation isolation valve, and safety valve.

7. The system according to claim 1 wherein the wellbore completion device is a flow control device that forms part of an intelligent completion.

8. The system according to claim 1 wherein said low power downhole source of energy is energy transmitted using a technology selected from a group consisting of: subsea wellhead, inductive couplers and optical connections.

9. The system according to claim 1 wherein said low power downhole source of energy is energy harvested from fluid flowing downhole.

10. The system according to claim 1 wherein said low power downhole source of energy is energy harvested from vibration, thermal and/or rotational energy.

11. The system according to claim 2 wherein the flywheel is formed at least in part of fiber reinforced composite material.

12. The system according to claim 2 wherein said flywheel is supported by magnetic bearings.

13. The system according to claim 1 wherein said electric machine is of a type selected from a group consisting of: DC brush, DC brushless, switched reluctance, inductance and AC electric.

14. The system according to claim 1 wherein the high power electrical energy from said electric machine is used to boost power past an inductive coupler or an optical fiber connection such that the power can be used by said wellbore completion device.

15. A method of storing kinetic energy for use downhole comprising:

receiving a low power energy from a low power energy source;

converting the received low power energy into rotational kinetic energy using an electric machine operating as a motor;

storing the rotational kinetic energy in a flywheel system;

when needed, converting the rotational kinetic energy stored in the flywheel system into a high power electric energy using the electric machine operating as a generator; and actuating a wellbore completion device using the high power electric energy, wherein said actuating uses the high power electric energy at a rate exceeding that produced by said low power energy source.

16. The method according to claim 15 wherein said flywheel system, said electric machine and the wellbore completion device are configured for permanent or semi-permanent deployment in a wellbore for more than 5 years.

17. The method according to claim 15 wherein the wellbore completion device is of a type selected from a group consisting of: flow control valve, flow control sleeve, formation isolation valve, and safety valve.

18. The method according to claim 15 wherein said low power energy source is energy transmitted using a technology selected from a group consisting of: subsea wellhead, inductive couplers and optical connections.

* * * * *